United States Patent [19]

Haas

[11] 4,260,338

[45] Apr. 7, 1981

[54] MULTICYLINDER PUMP FOR VISCOUS LIQUIDS

[75] Inventor: Manfred Haas, Herten, Fed. Rep. of Germany

[73] Assignee: Friedrich Wilh. Schwing GmbH, Fed. Rep. of Germany

[21] Appl. No.: 47,031

[22] Filed: Jun. 8, 1979

[30] Foreign Application Priority Data

Jun. 8, 1978 [DE] Fed. Rep. of Germany ..... 2825144

[51] Int. Cl.[3] ..... F04B 21/02; F04B 35/02

[52] U.S. Cl. ..... 417/346

[58] Field of Search ..... 417/339, 344, 346

[56] References Cited

U.S. PATENT DOCUMENTS 3,893,790 7/1975 Mayer ..... 417/346

3,994,627 11/1976 Calzolari ..... 417/344

*Primary Examiner*—Edward L. Roberts

*Attorney, Agent, or Firm*—Remy J. VanOphem

[57] ABSTRACT

A multicylinder piston pump for pumping viscous liquids of varying composition with each cylinder having an extendible tubular piston intake valve and discharge valve is disclosed. The extendible tubular piston valves have a tubular piston slidably mounted in a cylindrical passage of a housing mounted adjacent to each cylinder. The tubular piston has an inner bore into which an inner piston is slidably mounted therein. The inner piston is connected to a piston rod which is connected to the housing. Hydraulic oil is used to extend each tubular piston valve so as to control the intake and discharge of fluid into the piston pump.

10 Claims, 4 Drawing Figures

MULTICYLINDER PUMP FOR VISCOUS LIQUIDS

BACKGROUND OF THE INVENTION

1. Field of the Invention

The invention pertains to a multicylinder pump for viscous liquids having a control valve unit on each cylinder consisting of two valves, an intake valve and discharge valve for each plunger piston. The plunger piston is acted upon by the hydraulic medium in a dual manner; one pressure and one intake valve from two of the cylinders are closed and then opened when the other two corresponding valves are closed.

In particular, this invention is applicable to two-cylinder piston pumps, which have the above mentioned four valves. Pumps installed according to this invention serve to pump thick liquids, which from time to time have different compositions. In addition to contaminated water, for example, water contaminated with various substances such as wood which collects from ships docking in Kiel, other solid contaminants such as mortar and concrete are discharged by pumps of this invention. The multicylinder piston-pump is guaranteed by its very construction to prevent any connection between the intake and compression stroke. In this way, a break in the circuit between the discharge outlet and discharge-medium inlet, such as in the case of a mortar and concrete discharge medium, will be replaced by a collection hopper inserted in the line.

2. Description of the Prior Art

It is known that in the multicylinder piston pumps, requirements such as those above, are fulfilled by valve seats. For this purpose, one employs a spherical or tapered valve head mounted on a rod, which by means of a hydraulic cylinder, can be moved so as to open or close the valve. One can select the dimensions so that the diameter of the valve seat is approximately four times the diameter of the rod. If, for example, the pumps are used for discharging a medium containing cement, difficulties will arise because the valves will lose their water-tightness. This can be attributed to the fact that the discharge medium will build up behind the head of the pressure valve and thus block the valve.

There are also pumps which have plunger piston valves having a tapered end. The deposit from the discharge medium is separated out during the return stroke of the piston. In this way, these valves have the advantage of remaining completely open so as to maintain a free cross-section of flow. There are still difficulties if one increases the shut-off cross-section by means of the plunger piston valve. Specifically in those cases, the pressure from the discharge medium which is exerted on the piston requires an enlargement in the size of the drive piston in the hydraulic cylinder. In turn, the volume of hydraulic medium necessary for the piston to move must also be greatly increased. As a result, there is an increase in the time-interruption during the pumping action of the piston. In addition, the back-up volume of the discharge medium increases when the valve is open and in turn leads to a further time-interruption in the pumping-cycle. This discontinuity of the discharge flow has a damaging effect on the pump's operation. If on the other hand, a large cross-section of flow were provided for the discharge mass a more continuous flow would result.

The invention poses the following task: to construct a plunger-piston for the multicylinder pump in such a way so that the front edge of the piston which is acted upon by the pressure of the discharge medium will comprise only a portion of the entire piston head. Also, the necessary dimensions of the intake cylinder should correspondingly be reduced so as to allow for the motion of the piston.

SUMMARY OF THE INVENTION

According to the invention, this problem will be solved by constructing the plunger piston in each valve in the form of a tubular-piston with grooves for piston rings. The tubular piston or plunger is installed in a fixed outer ring on a piston rod moving axially related to the plunger piston. This piston rod is also attached to an inner surface of the piston that moves opposite to the path of travel of the plunger.

With this design, the pressure exerted on the frontal edge of the plunger piston is equal to that on the front of the tube because the pressure exerted on the walls of the tube by the discharge medium is transmitted to the inner surface of the piston on the piston rod. The plunger moves along the outer and inner guides and given the large cross-sections of the openings, requires only a small volume hydraulic medium for movement. The construction of the plunger as a valve seat leads to absolute sealing as opposed to split-sealing with the plunger piston, which is at best an insufficient seal. The tubular piston or plunger construction of the present invention has further proven itself to be advantageous in holding up to wear for coarse, abrasive discharge media.

The invention has, in this way, the chief advantage of providing a more continuous discharge pumping operation when the cross-section of flow is greatly increased.

In principle, the drive mechanism for the plunger or the tubular piston operates so as to actuate one or more hydraulic cylinders distributed along a traverse guide arm. In contrast to this, there are more compact designs in which the hydraulic cylinder required to operate the plunger or the tubular piston is assembled along with the movable piston head and plunger into a single functional unit.

That is the case with one of the design variations of the invention. Namely, the plunger has an annular or tubular piston which travels in the hydraulic or working cylinder enclosed by the plunger or tubular piston. The working cylinder has a hollowed-out base plate attached to the piston rod.

In a functional unit such as described above, a shut-off device must also be provided, which controls the rigorous sequence of opening and closing. For this purpose, the invention has accordingly been provided with an annular groove on the portion of the plunger or tubular piston which extends outside the hydraulic or working cylinder. The groove and working-area of the plunger piston engage to form a radially-rupturing shut-off device, which closes-off the flow of hydraulic fluid when the plunger piston is plugged up.

BRIEF DESCRIPTION OF THE DRAWINGS

The components, further notes and other explanations of the invention are given in the following description of one of the designs along with the following illustration.

DETAILED DESCRIPTION OF THE PREFERRED EMBODIMENT

Figure 1:
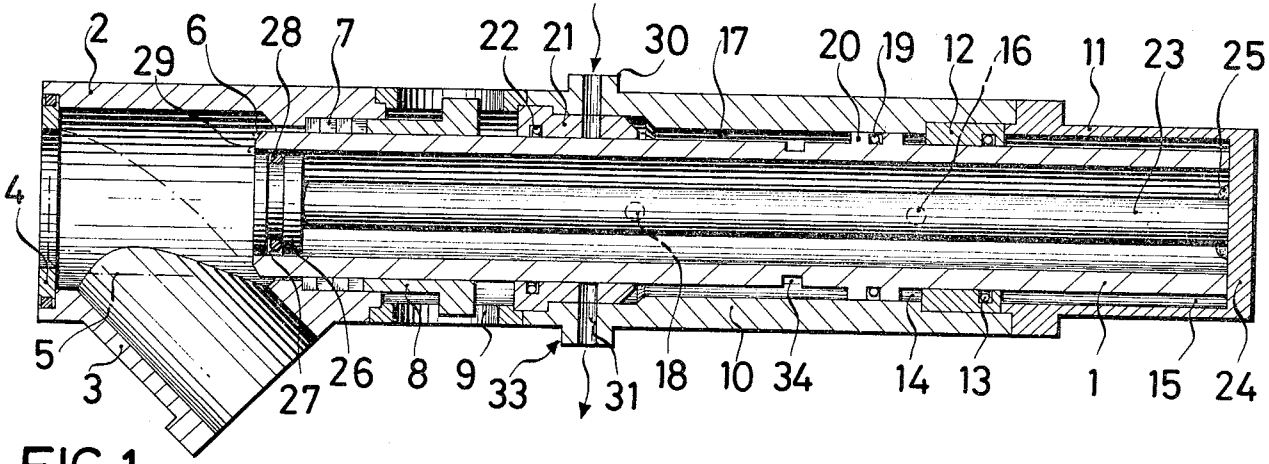
FIG. 1 is a longitudinal cross-section of a shut-off valve according to the invention.

According to the illustration in FIG. 1, a tubular piston or plunger 1 serves as a movable part of the valve seat, which is shown in its retracted position and in the cross-sectional view of the valve is shown in its released position. The valve housing is indicated by 2 and has a tapered portion 3 to the direction of flow. The valve housing is equipped with a ring or valve seat 4 whereby the position of the plunger 1 in its extended postion on the valve seat 4 is shown by dashed lines 5. The tapered groove 6 seated on the valve seat 4 seals the ring.

The plunger 1 is sealed in the housing 2 by means of a sealer 7, which can be pressed together with a packing box or sealing-box 8. The packing box is located in an intermediary flange 9, which serves as an attachment to the hydraulic cylinder 10. A hollowed-out base plate 11 is screwed to the hydraulic cylinder 10. The base plate 11 forms an assembly with the annular ring 12 on the inner side of the hydraulic cylinder 10. This assembly guides the plunger 1 and with the help of a gasket 13 seals the compression space 14 formed inside the cylinder 10, against the hollow-space 15 of the base plate 11. The compression space 14 is equipped with a connection 16 for feeding in the hydraulic fluid. Another compression space 17 serves as a feedback line and also has a connection 18.

Both compression spaces 14 and 17 are circular and are sealed against one another by a gasket 19 which is located in one of the piston rings 20 and forms an assembly with the plunger 1.

Another outer ring 21 forms the front-most connection to the compression space 17 in the hydraulic cylinder 10 and is pressed between the cylinder and flange 9. A gasket 22 provides a pressure tight connection between the compression space 17 and plunger 1. The plunger 1 is in this way guided by the two outer rings 12 and 21.

In the plunger, a piston rod 23 is located axially and is attached to a washer-like cap 24 in the hollowed out base plate 11 as shown in FIG. 1. That is, according to the design example as indicated by item 25 it can be either welded or screwed on. The other end of the piston rod 23 is attached to the inner surface of the piston head 26 which has a gasket ring 28 in a radial groove 27. The dimensions are selected in such a way, so that the outer surface of the piston 26 will be closely aligned with the front edge 29 when the tubular piston or plunger 1 is fully retracted. For this reason, a hollow space 15 is provided for the tubular piston 1 to enter when the plunger is fully retracted. Thus, the tubular piston moves relative to the piston head 26 and the hydraulic cylinder 10.

A collar 30 is integrally formed with the cylinder 10. This collar 30 has a radial aperture 31 and forms the static part of a shut-off assembly. Together with the outer ring 21 and a radial aperture 32 aligned with aperture 31, these components form the static part of a common shut-off assembly 33. The moveable part of this shut-off assembly 33 is formed from an annular groove 34 located between the piston ring 20 and front edge 29 of the plunger 1. In the closed position, indicated by number 5, of the plunger 1, the annular groove 34 is aligned with the radial apertures 31, 32, so that the shut-off assembly 33 is opened and the hydraulic fluid flow shown by the arrow in FIG. 1, is established.

Figure 2:
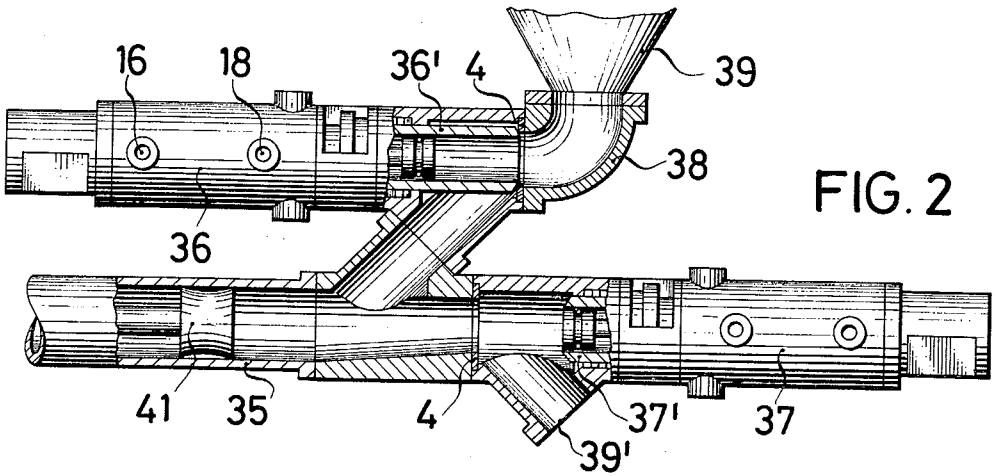
FIG. 2 likewise is a cut-away view of a two-cylinder piston pump according to the invention, with the cross-section of the largest part.

In the design example shown in FIG. 2, each of the working or main cylinders 35 of the dual cylinder piston pump has a control valve unit which is equipped with the two piston valves or the drive cylinders 36, 37 whose design construction is shown in FIG. 1. Thus, the multi-cylinder pump for viscous liquids each having a control valve unit on each cylinder consisting of two valves, an intake valve 36 and a discharge or pressure valve 37 for each plunger piston. The plunger piston 36′ of the intake piston valve 36, is sealed by an annular seat 4 on the connection 38 which leads to a hopper 39. The plunger piston 37′ of the discharge piston valve 37 controls the discharge direction through the annular seat 4 either toward or away from the hopper 39. The main or plunger piston of the pump is shown as item 41. The plunger piston is acted upon by the hydraulic oil in a dual manner; one pressure and one intake valve from two of the cylinders are closed and then opened when the other two corresponding valves are closed. The circuit schematic of FIG. 3 describes the operation of the hydraulic oil system in detail.

Figure 3:
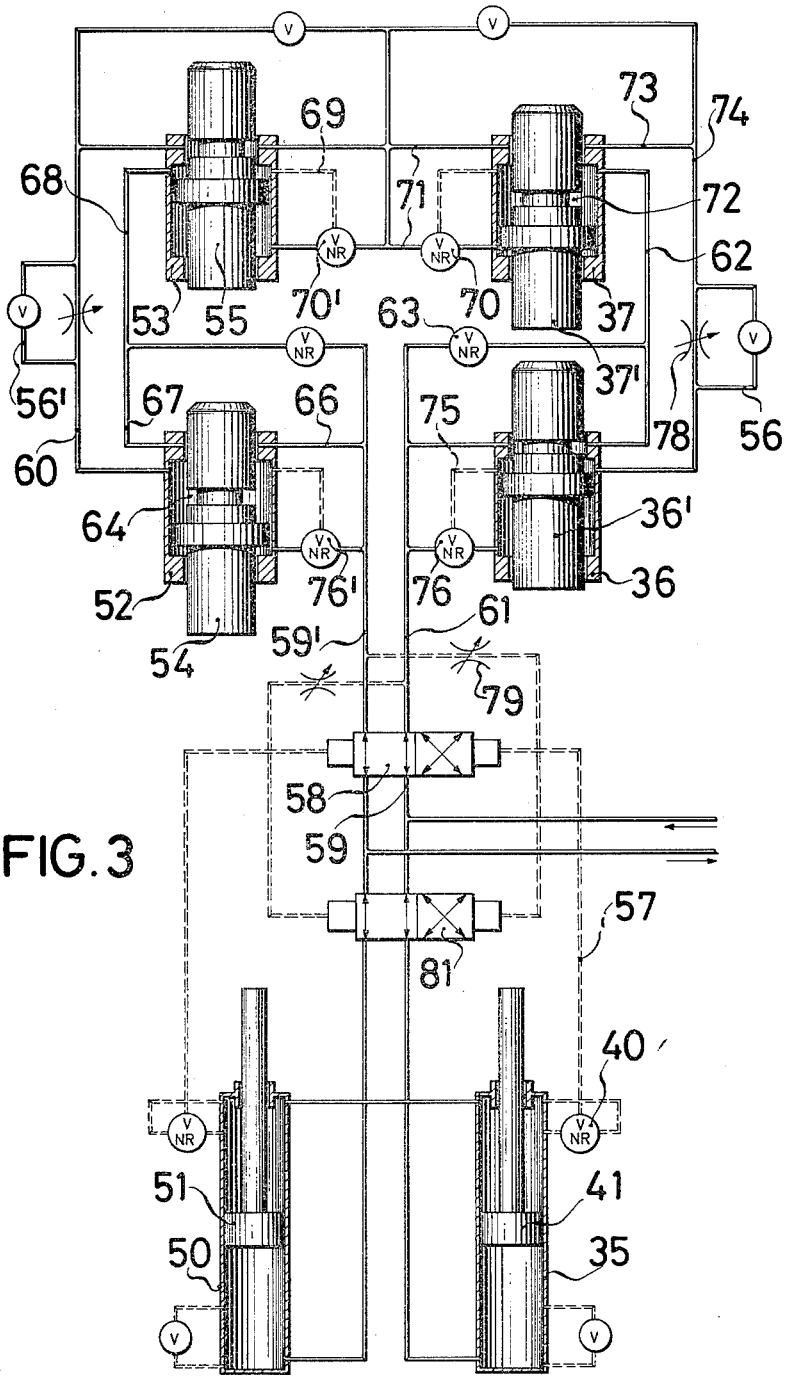
FIG. 3 is a schematic of the hydraulic switches for the two-cylinder piston pump shown in FIGS. 1 and 2.

According to the schematic shown in FIG. 3, the main or pump cylinder 35, shown in FIG. 2, corresponds or is equivalent to the main or working cylinder 50 in which the plunger piston 51 operates. The piston valves or the drive cylinders 52 and 53 for the plunger pistons 54 and 55 correspond or equivalent to the piston valves or to drive cylinders 36 and 37 for the plunger pistons 36′ and 37′ respectively of FIG. 2. These parts are arranged in such a way that in the circuit schematic FIG. 3, the pressure is exerted on the piston side of the operating or pump cylinder 35, and the plunger piston 41 in its movement to a forward position opens a channel, through which the hydraulic oil acts directly upon the feed-back valve 40 and through a control circuit 57 is thus converged to a two-way valve 58. This two-way valve 58 is actuated by the direct exertion of hydraulic oil pressure thereon. The hydraulic oil emanating from the connection 59 reaches the drive cylinders or the piston valves 52, 37 through the lines 59′, 60 and 71. The hydraulic oil squeezed out by the plunger piston 54 flows through the lines 60 and 71 and serves to drive the discharge piston valve or the drive cylinder 37, whose feedback hydraulic oil flows through line 62 and a feedback valve 63 to a tank reservoir.

If the plunger 54 in the intake drive cylinder 52 reaches it forward most position (closed-position) and the synchronized plunger piston 37′ in the discharge drive cylinder 37 reaches its corresponding end point, the groove 64 of the plunger piston 54 connects both lines 66 and 67 so that even more hydraulic will flow through line 68 and exert pressure upon the plunger piston 55 of the discharge drive cylinder 53 and it turn open the valve seat.

The unlocked feed-back valve 70′ will be opened by the control line 69, so that the hydraulic oil squeezed out by the plunger piston 55 through a line 71 will reach the groove 72 and lines 73 and 74 as well as the valve 56 to the intake drive cylinder 36 and exert pressure on the plunger piston 36′. In this way, the unlocked feedback valve 76 will be opened by the control line 75, so that the feedback hydraulic oil from the intake drive cylinder 36 can flow back to the tank reservoir through line 61. Because all of the piston valves or the drive cylinders 52, 53, 36, 37 have the same stroke and are constructed as synchronized drive cylinders, they cannot be closed-off, which as a result of the leakage of feedback oil from the drive cylinder 52, is insufficient to bring the plunger piston 37' in the discharge drive cylinder 37 to its end position.

To avoid a short-circuit between the pressure and inlet side, it is absolutely necessary that before opening the piston valves on the drive cylinders 36 and 53, the drive cylinders 52 and 37 must be closed.

Since it is natural for the pressure to be less in order to close the inlet valve or the inlet drive cylinder 52 and open the inlet valve or the inlet drive cylinder 36 as well as the pressure valve or the discharge drive cylinder 53, than to close the pressure valve or the discharge drive cylinder 37, the pressure in the main line 74 to the inlet valve of the inlet drive cylinder 36 must be artifically raised by means of throttling. A throttle feedback valve 78 serves this purpose.

During this control process, the plunger valve circulates hydraulic oil from line 59 through a throttle 79 and control line 80 to valve 81, which changes the direction of the plunger piston in main cylinders 35 and 50. The throttle 79 is set so high, that the reversal of the valve 81 ceases simultaneously with the reversing process, the plunger piston 51 in the pump cylinder 50 moves forward. Upon reaching its farthest forward position, it begins the reverse process, which, as described above, proceeds as a result of the symmetrical construction of the circuits but in its proper sequence.

Figure 4:
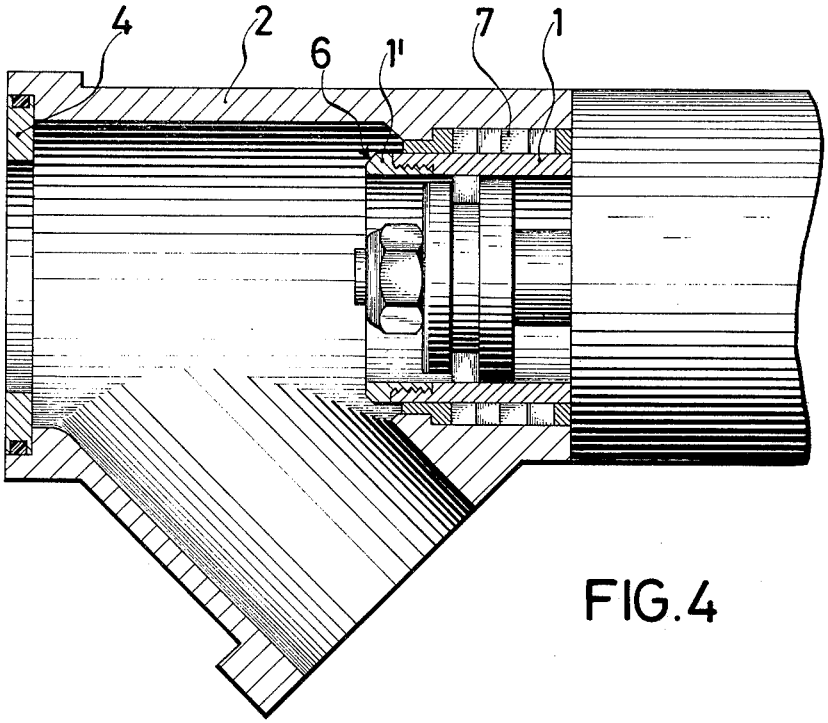
FIG. 4 is an oversized view of the front end of plunger or tubular piston corresponding to the illustration in FIG. 1.

According to the illustration in FIG. 4, the ring member 6 on the ring 1' is constructed to be interchangeable with the front end of the tubular piston on the plunger. In this way, the ring member with its male-threaded end can be screwed into a corresponding female thread on the end of the plunger 1. One can then unscrew the ring member and not have to change the plunger 1 to provide a seal for the seat 6.

What is claimed is:

1. In a piston pump for pumping fluids of varying composition wherein said pump having at least two cylinders and hydraulic pressure means, one of said at least two cylinders operating in phased opposition to the other of said at least two cylinders, each of said at least two cylinders having a bore and a piston slidably mounted in said bore for reciprocation therein, wherein said improvement comprises:

extendible tubular piston valve means, mounted adjacent to each of said at least two cylinders and connected to said bore of each of said at least two cylinders for controlling the intake and the discharge of said fluids into each of said at least two cylinders; and means, connected to said hydraulic pressure means, for alternatively closing and opening said extendible tubular piston valve means in response to the reciprocation of said piston.

2. A piston pump for pumping fluids of varying composition, said pump comprising:

at least two cylinders, one of said at least two cylinders operating in phased opposition to another of said at least two cylinders, each of said at least two cylinders having a bore;

a piston slidably mounted in said bore for reciprocation therein;

extendible tubular piston intake valve means, mounted adjacent to each of said at least two cylinders and connected to said bore, for controlling the intake of said fluid into each of said at least two cylinders;

extendible tubular piston discharge valve means, mounted adjacent to each of said at least two cylinders and connected to said bore, for controlling the discharge of said fluid out of each of said at least two cylinders; and means, connected to said extendible tubular piston intake valve means and said extendible tubular piston discharge valve means, for alternatingly closing said extendible tubular piston intake valve means and opening said extendible tubular piston discharge valve means is response to the reciprocation of said piston in said bore such that when said extendible tubular piston discharge valve means closes on said one of said at least two cylinders, said extendible tubular piston intake valve means opens on said another of said at least two cylinders and when said extendible tubular piston intake valve means closes on said one of said at least two cylinders, said extendible tubular piston discharge valve means opens on said another of said at least two cylinders.

3. A piston pump as claimed in claim 2 wherein said alternatingly closing and opening means further comprises:

hydraulic oil pressure means; and valve means, connected to said hydraulic oil pressure means, for supplying hydraulic oil pressure means to said extendible tubular piston intake valve means and said extendible tubular piston discharge valve means so as to control the opening and closing of said tubular piston intake and discharge valve means.

4. A piston pump as claimed in claim 3 further comprising means for preventing said extendible tubular piston discharge valve means from closing as a result of leakage of said hydraulic oil pressure means.

5. A piston pump as claimed in claim 3, wherein each of said extendible tubular piston intake and discharge valve means further comprises:

at least one housing mounted adjacent to said each of said at least two cylinders, said at least one housing having portions defining a cylindrical passage therein and a flow passage connecting said cylindrical passage with said bore in said each of said at least two cylinders for flow communication therebetween;

a tubular piston slidably mounted in said cylindrical passage of said at least one housing, said tubular piston having an outside diameter and portions defining an inner bore, said inner bore having one end and an opposite end, said one end having a piston ring member;

an inner piston slidably mounted in said inner bore of said tubular piston, and a piston rod disposed axially within said inner bore of said tubular piston, said piston rod having a first end and a second end opposite said first end, said first end of said piston rod connected to said inner piston and said second end of said piston rod connected to said at least one housing.

6. A piston pump according to claim 5 wherein said tubular piston further having a piston ring mounted on said outside diameter; and further comprising first means, disposed between said bore of said at least one housing and said outside diameter of said tubular piston, for forming a cavity between said opposite end of said tubular piston and said piston ring.

7. A piston pump according to claim 6 wherein said at least one housing having a base and portions defining a radial aperture between said ends of said tubular piston wherein said supply valve means further comprises second means disposed between said base of said at least one housing and said outside diameter of said tubular piston forming portions defining a annular groove disposed between said one end and said opposite end of said tubular piston cooperating with said radial aperture so as to form a shut-off valve to control said hydraulic oil pressure means acting on said tubular piston.

8. A piston pump according to claim 7 wherein said supply valve means further comprises:

a first hydraulic valve connected to said tubular piston intake valve means;

a second hydraulic valve connected to said tubular piston discharge valve means;

a first unlocked feedback valve connected to said first hydraulic valve; and a second unlocked feedback valve connected to said second hydraulic valve.

9. A piston pump according to claim 7 wherein said supply valve means further comprises:

a first throttle feedback valve connected to said extendible tubular piston intake valve means.

10. A piston pump according to claim 3 wherein each of said extendible tubular piston intake and discharge valve means further comprises:

at least one housing mounted adjacent to said each of said at least two cylinders, said at least one housing having one end, a second end opposite said one end, and a cylindrical passage therebetween, said one end having a piston ring seat;

a tubular piston slidably mounted in said cylindrical passage of said at least one housing, said tubular piston having an inner bore, said inner bore having one end and an opposite end, said one end communicating with said piston ring seat of said at least one housing.

* * * * *

UNITED STATES PATENT OFFICE

CERTIFICATE OF CORRECTION

Patent No. 4,260,338 Dated April 7, 1981

Inventor(s) Mr. Manfred Haas

It is certified that error appears in the above-identified patent and that said Letters Patent are hereby corrected as shown below:

Column 4, line 43, delete "converged" and insert ----conveyed----.

Column 4, line 53, after the word "plunger" insert ----piston----.

Column 4, line 54, delete "it" insert ----its----.

Column 4, line 60, after the word "and" delete "it" and insert ----in----.

Column 5, line 19, after the words "37, the" insert ----hydraulic oil----.

CERTIFICATE OF CORRECTION

Patent No. 4,260,338 Dated April 7, 1981

Inventor(s) Mr. Manfred Haas

It is certified that error appears in the above-identified patent and that said Letters Patent are hereby corrected as shown below:

Column 5, line 36, after the word "piston" delete "on" and insert ----or----.

Column 6, line 16, delete "is and insert ----in----.

Column 6, line 59, after the word "piston" delete the "," and insert ----;----.

Signed and Sealed this

*Fourth* Day of *August 1981*

[SEAL]

*Attest:*

GERALD J. MOSSINGHOFF

*Attesting Officer*

*Commissioner of Patents and Trademarks*